United States Patent [19]

Barrington et al.

[11] Patent Number: 4,646,829

[45] Date of Patent: Mar. 3, 1987

[54] HYDRAULICALLY SET AND RELEASED BRIDGE PLUG

[75] Inventors: Burchus Q. Barrington; Robert T. Evans, both of Duncan, Okla.; Bernard L. Hackney, Pearland, Tex.

[73] Assignee: Halliburton Company, Duncan, Okla.

[21] Appl. No.: 721,622

[22] Filed: Apr. 10, 1985

[51] Int. Cl.[4] ..... E21B 33/128

[52] U.S. Cl. ..... 166/125; 166/135; 166/140; 166/182; 166/192

[58] Field of Search ..... 166/123, 125, 138, 139, 166/140, 134, 135, 181, 182, 183, 185, 192; 285/83, 18, 306, 920

[56] References Cited

U.S. PATENT DOCUMENTS

| | | | |
|---|---|---|---|
| 1,915,771 | 6/1933 | Wickersham et al. . | |
| 2,239,150 | 4/1941 | Halliburton . | |
| 2,352,700 | 7/1944 | Ferris . | |
| 2,715,444 | 8/1955 | Fewel | 166/187 |
| 2,799,346 | 7/1957 | Baker et al. | 166/135 |
| 2,806,532 | 9/1957 | Baker et al. . | |
| 2,925,865 | 2/1960 | Oliver | 166/154 |
| 2,946,388 | 7/1960 | Evans | 166/120 |
| 3,054,452 | 9/1962 | Evans | 166/178 |
| 3,100,533 | 8/1963 | Fredd | 166/181 |
| 3,122,205 | 9/1962 | Brown et al. | 166/122 |
| 3,136,364 | 6/1964 | Myers | 166/120 |
| 3,189,096 | 6/1965 | Phenix | 166/133 |
| 3,215,204 | 11/1965 | Sims | 285/306 |
| 3,714,983 | 2/1973 | Wilson | 166/120 |
| 4,149,594 | 4/1979 | Evans | 166/134 |
| 4,289,202 | 9/1981 | Henderson | 285/18 |
| 4,437,516 | 3/1984 | Cockrell | 166/120 |
| 4,516,634 | 5/1985 | Pitts | 166/125 |
| 4,545,431 | 10/1985 | Fore | 166/134 |

OTHER PUBLICATIONS

Halliburton Services Sales and Service Catalog No. 41, p. 4014.

*Primary Examiner*—Stephen J. Novosad
*Assistant Examiner*—William P. Neuder
*Attorney, Agent, or Firm*—James R. Duzan; L. Wayne Beavers

[57] ABSTRACT

A bridge plug apparatus includes a mandrel assembly having an operating fluid passageway disposed therein. A releasable coupling assembly has an upper end adapted to be connected to a tubing string and has a lower portion adapted to be releasably connected to the mandrel assembly. An annular packer is disposed about the mandrel assembly. A mechanical first slip assembly is connected to the mandrel assembly below the packer. A hydraulic second slip assembly is connected to the mandrel assembly above the packer. A power piston is disposed about the mandrel assembly for longitudinally compressing and radially expanding the packer to seal the packer in response to an increase in fluid pressure within the operating fluid passageway of the mandrel assembly. A hydraulically actuatable releasing device is provided for releasing a latched connection between the coupling assembly and the mandrel assembly. This releasing device is defined upon a power sleeve slidably disposed about the mandrel assembly. This power sleeve also has defined thereon a first valve portion for closing a bypass passage of the mandrel assembly and a second valve portion for trapping fluid under pressure within a portion of the operating fluid passageway of the mandrel assembly communicated with the hydraulic second slip assembly and the power piston.

18 Claims, 7 Drawing Figures

HYDRAULICALLY SET AND RELEASED BRIDGE PLUG

BACKGROUND OF THE INVENTION

1. Field of the Invention

The present invention relates to apparatus for use in oil and gas wells or the like, and particularly to packing devices commonly referred to as bridge plugs.

2. Description of the Prior Art

During the various testing or treating operations which are normally performed on an oil or gas well, there is often need to provide a means for blocking fluid flow through the well bore. One class of such devices is referred to as bridge plugs. These devices commonly include an annular sealing element for sealing against a well bore, and means for preventing flow through the bridge plug.

Such bridge plugs are often run in conjunction with conventional packers to isolate a zone in a well for testing or treating. Also, such bridge plugs may be used alone to isolate zones for service work or testing.

Usually, bridge plugs are lowered into place within the well bore on a tubing string, and are constructed to be set at their desired location within the well bore by various manipulations of this tubing string. Most often, the bridge plugs are designed to be set by setting down the weight of the tubing string on the bridge plug after a set of slips have been initially set by rotational motion of the tubing string or other means.

With these most commonly used types of bridge plugs, it is often difficult to set the bridge plug in either shallow or deviated bore holes. This is because it is difficult in such holes to set sufficient weight down on the bridge plug to create an effective seal of the sealing element of the bridge plug against the well bore. In shallow holes, the relatively short length of the tubing string simply does not weigh enough to provide sufficient weight for properly setting the bridge plug. In deviated holes, the drag of the tubing string against the bore hole subtracts substantially from the weight which can be set down on the bridge plug, causing similar problems in providing sufficient downward weight on the bridge plug to effectively seal the bridge plug against the well bore.

It has been proposed in the prior art to utilize bridge plugs which are actuated by hydraulic pressure rather than by manipulation of the tubing string. An example of such a hydraulically actuated bridge plug is shown in U.S. Pat. No. 2,946,388 to Evans.

The present invention provides a very much improved device of the type generally shown in the Evans patent.

SUMMARY OF THE INVENTION

The bridge plug apparatus of the present invention includes a mandrel means having an operating fluid passageway disposed therein. A releasable coupling means has an upper end adapted to be connected to a tubing string and has a lower end portion adapted to be releasably connected to the mandrel means.

An annular packer means is disposed about the mandrel means. A mechanical first slip means is connected to the mandrel means below the packet means for anchoring the mandrel means against downward movement within the well bore. A hydraulic second slip means is connected to the mandrel means above the packer means for anchoring the mandrel means against upward movement within the well bore.

A power piston means is provided for longitudinally compressing and radially expanding the packer means to seal the packer means against the well bore in response to an increase in fluid pressure within the operating fluid passageway of the mandrel means. A hydraulically actuatable release means is provided for releasing the coupling means from latched connection to the mandrel means in response to a further increase in fluid pressure within the operating fluid passageway after the packer means is expanded by the power piston means. This hydraulically actuatable release means includes a spring collet which is operatively associated with a power sleeve disposed about the mandrel means. The power sleeve is moved in response to increases in fluid pressure within the fluid passageway of the mandrel means, and engages the spring collet to release the latched connection between the coupling means and the mandrel means.

The mandrel means has a bypass passage disposed therethrough.

When the power sleeve moves relative to the mandrel means to engage the spring collet, the power sleeve also closes the bypass passage, and closes a valve means for trapping fluid under pressure in a portion of the operating fluid passageway communicated with the power piston so as to hold the power piston in its position wherein the packer means is expanded.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

The Mandrel Assembly

Figure 1A:
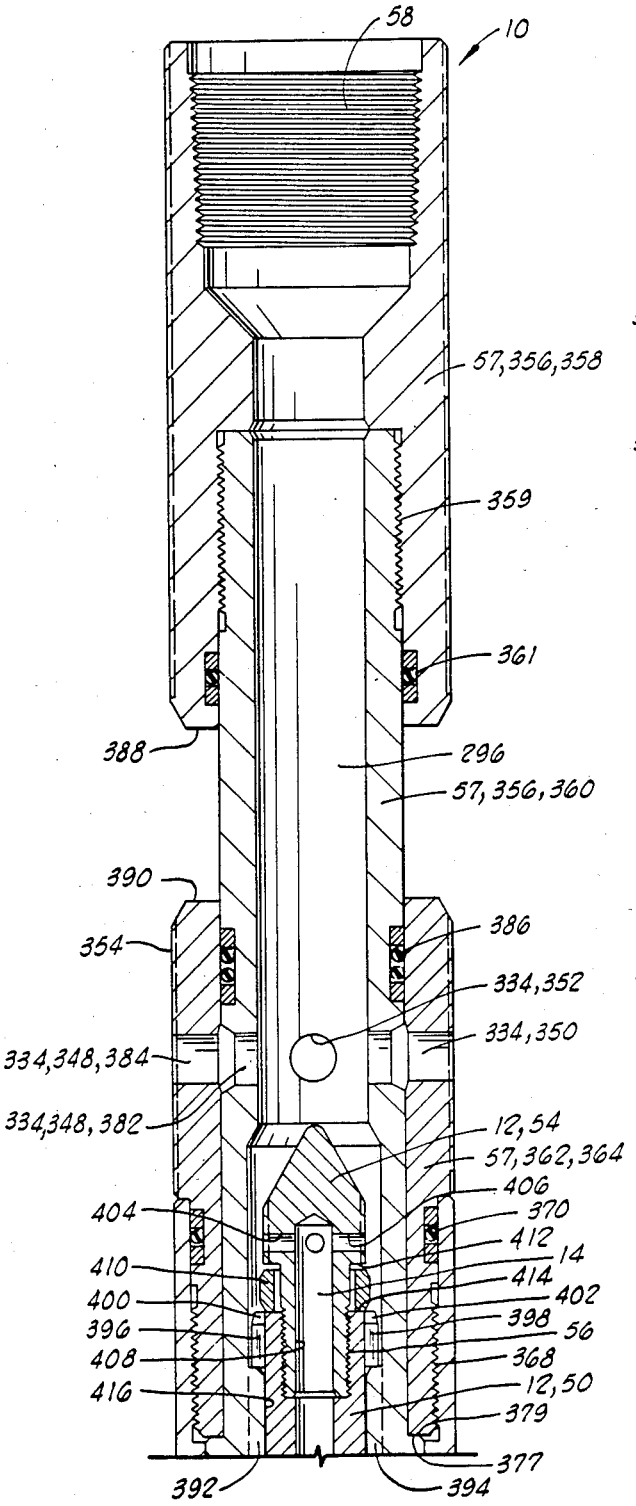
FIGS. 1A–1F comprise a sectioned elevation view of the bridge plug apparatus of the present invention.

Referring now to the drawings and particularly to FIGS. 1A–1F, the bridge plug apparatus of the present invention is shown and generally designated by the numeral 10. The bridge plug apparatus 10 includes a mandrel means generally designated by the numeral 12 having an operating fluid passageway generally designated by the numeral 14 disposed therethrough.

The mandrel means 12 is formed from a plurality of threaded connected tubular members which, beginning at the lower end thereof, includes a drag block mandrel 16. The drag block mandrel 16 includes external threads 18 at its lower end for connection thereof to a tubing string or to other equipment located below the bridge plug apparatus 10.

An upper end of drag block mandrel 16 is connected at threaded connection 20 to a lower end of packer mandrel 22 of mandrel means 12.

An upper end of packer mandrel 22 is connected at threaded connection 24 to a hydraulic slip body 26 of mandrel means 12, and a seal is provided therebetween by resilient O-ring seal means 27.

An upper end of hydraulic slip body 26 is connected at threaded connection 28 to a lower end of bypass mandrel 30 of mandrel means 12, and a seal is provided therebetween by resilient O-ring seal means 31.

Mandrel means 12 further includes a bypass tube 32 which has its lower end closely received within an upward facing counterbore 34 of packer mandrel 11 with a seal being provided therebetween by resilient O-ring seal means 36. An upper end of bypass tube 32 is closely received within a downward facing counterbore 38 of bypass mandrel 30 with a seal means being provided therebetween by resilient O-ring seals 40.

An upper portion of bypass mandrel 30 is connected at threaded connection 42 to a lower end of check valve mandrel 44 of mandrel means 12, with a seal being provided therebetween by resilient O-ring seal means 46.

An upper end of check valve mandrel 44 is connected at threaded connection 48 to a lower portion of release mandrel 50 of mandrel means 12 with a seal being provided therebetween by resilient O-ring seal means 52.

Mandrel means 12 includes a mandrel nose 54 having its lower end threadedly connected to an upper end of release mandrel 50 at threaded connection 56.

Bridge plug apparatus 10 further includes a releasable coupling means 57 having an internal threaded surface 58 at its upper end for threadedly engaging a tubing string (not shown) upon which the bridge plug apparatus 10 is lowered into a well bore (not shown), and has a lower portion 60 adapted to be releasably connected to the mandrel means 12. Coupling means 57 is commonly referred to as an overshot.

The Packer Assembly

An annular packer means 62 is disposed about packer mandrel 22 of mandrel means 12. The general construction of packer means 62 is well known to those skilled in the art and it comprises an annular member of elastomeric material or other material which can radially expand upon being longitudinally compressed. The particular packer means 62 shown in FIG. 1E includes upper and lower expandable portions 64 and 66, respectively, divided by a metal ring 68.

The Mechanical Lower Slips

A mechanical first slip means generally designated by the numeral 70 is connected to drag block mandrel 16 and packer mandrel 22 of mandrel means 12 for anchoring the mandrel means 12 within the well bore upon manipulation of the tubing string connected to the bridge plug apparatus 10.

The mechanical first slip means 70 includes a plurality of circumferentially spaced slip segments such as 72 and 74 which have upwardly radially outward tapered internal surfaces 76 and 78 at their upper ends, which tapered surfaces engage a complimentary conically tapered surface 80 of an annular wedge member 82.

Lower ends 84 and 86 of slip segments 72 and 74 rest upon an upward facing downwardly and radially outwardly sloped annular surface 88 of an annular slip support ring 90.

Annular slip support 90 has an annular radially inward extending flange 92 at its lower end which interlocks with an annular radially outward extending flange 94 disposed upon the upper end of a drag block sleeve 96.

The drag block sleeve 96 has a pair of diametrically opposed inverted J-slots 98 and 100 disposed in the wall thereof. A pair of diametrically opposed lugs 102 and 104 extend radially outward from drag block mandrel 16 and are received in the J-slots 98 and 100, respectively.

Disposed within drag block sleeve 96 are a plurality of circumferentially spaced drag blocks such as 106 and 108 which are biased radially outward by arched drag block springs such as 110 and 112, respectively.

Drag block 108 has an upwardly extending lip 114 at its upper end which is received radially inward of an annular upper retaining sleeve 116 which slips over an intermediate flange 118 of drag block sleeve 96 and is connected thereto by welding as indicated at 120.

Drag block 106 includes a lower lip 122 extending from its lower end, which lower lip is retained radially inward of a lower retaining sleeve 124 which is threadedly connected to a lower end of drag block sleeve 96 at threaded connection 126.

Drag block 108 and the other drag blocks (not shown) are constructed and assembled in a manner similar to that just described for drag block 106.

Each of the arched drag block springs such as 110 and 112 have their radially inner portions bearing agsinst a second intermediate portion 128 of drag block sleeve 96.

Figure 2:
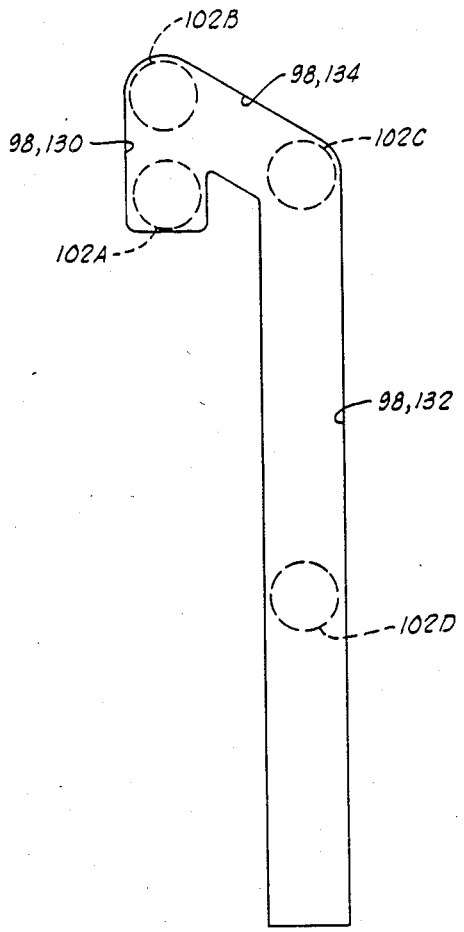
FIG. 2 is a laid-out view of the J-slot and lug arrangement between the drag block sleeve and the mandrel means of FIG. 1F.

Each of the J-slots 98 and 100 are identically constructed, and the J-slot 98 is shown in laid-out fashion in FIG. 2.

J-slot 98 includes a short vertical leg portion 130, a long vertical leg portion 132, and a sloped connecting portion 134 which interconnects the upper ends of short leg portion 130 and long leg portion 132.

Shown in dashed lines in FIG. 2 are several relative locations of lug 102 of drag block mandrel 16 relative to J-slot 98 during the operation of the mechanical first slip means 70.

As the tubing string with the bridge plug apparatus 10 attached thereto is being lowered downwardly into the well bore, the lug 102 is in the position 102A where it is trapped within the lower end of short leg portion 130 of J-slot 98.

When the bridge plug apparatus 10 is located at the position within the well bore where it is desired to be set, the well operator simultaneously picks up on the tubing string and torques it to the left, i.e., counterclockwise.

When the tubing string is picked up, the lug 102 moves from position 102A to position 102B at the upper end of the short leg portion 130 of J-slot 98. Then, as counterclockwise torque is applied to the tubing string and to the mandrel means 12 of bridge plug apparatus 10, the lug 102 moves from position 102B through the intermediate portion 134 of J-slot 98 to the position 102C at the upper end of long leg portion 132 of J-slot 98.

Then, weight is set back down on the tubing string and accordingly on the bridge plug apparatus 10 and the mandrel means 12 to move the mandrel means 12 downward relative to the drag block sleeve 96 so that lug 102 moves from position 102C to a position 102D near the lower end of long leg portion 132 of J-slot 98.

Throughout these various manipulations of the tubing string and the mandrel means 12 of bridge plug apparatus 10, the drag block sleeve 96 is held in a relatively fixed position due to the frictional engagement of drag blocks such as 106 and 108 with the internal bore of the well.

When mandrel means 12 moves downward relative to drag block sleeve 96 so that the lug 102 moves from position 102C to position 102D, the slip segments such as 72 and 74 of mechanical fist slip means 70 are cammed radially outward by engagement of the conical surface 80 of annular wedge member 82 with the internal tapered surfaces such as 76 and 78 of the slip segments 72 and 74. THus, the serrations such as 136 of the slip segments are caused to bite into the internal bore of the well so as to anchor the mandrel means 12 within the well bore against any downward movement of the mandrel means 12 relative to the well bore.

Also, when the tubing string weight is set down upon the bridge plug apparatus 10, a slight compressional load is applied longitudinally across the packer means 62 thus providing a relatively slight radially expansion thereof to begin the process of sealing the packer element 62 against the internal bore of the well.

The Power Piston

A power piston means 138 has an internal bore 140 which is closely and slidably received about an external surface 142 of packer mandrel 22 with a sliding seal being provided therebetween by resilient O-ring seal means 144.

Power piston means 138 includes an internal counterbore 146 which is closely received about an external surface 148 of hydraulic slip body 26 of mandrel means 12 with a sliding seal being provided therebetween by resilient O-ring seal means 150.

An annular power chamber 152 is defined between a lower end 154 of hydraulic slip body 26 and an upward facing shoulder 156 which joins bore 14 and counterbore 146 of power piston means 138. Power chamber 152 is communicated with operating fluid passage 14 of mandrel means 12 by a plurality of radial ports such as 158 and 160.

Any fluid pressure differential between the operating fluid passage 14 of mandrel means 12 and the well bore acts across a differential area defined between seals 144 and 150, which is equal to the area of shoulder 156, to force the power piston means 138 downward relative to mandrel means 12 so that it longitudinally compresses and radially expands the packer means 62 to seal the packer means 62 against the well bore in response to increases in fluid pressure within the operating fluid passageway 14.

The Hydraulic Upper Slips

Disposed within the hydraulic slip body 26 of mandrel means 12 is a hydraulic second slip means 162.

Hydraulic second slip means 162 includes a plurality of circumferentially spaced upper slip segments 164 (only one of which is shown). The upper slip segment 164 is loosely connected to hydraulic slip body 26 by a plurality of bolts 166, which are constructed such that some radially outward movement of upper slip segment 164 from the position shown in FIG. 1D is allowed.

Located within hydraulic slip body 26 are a plurality of radial bores such as 168 and 170 within which are received radial pistons such as 172 and 174. The pistons 172 and 174 are radially slidable within the bores 168 and 170 and resilient O-ring seals are provided therebetween as at 176 and 178.

The radially inner ends of pistons 172 and 174 are communicated with operating fluid passage 14 of mandrel means 12 by a plurality of radial ports 180.

Figure 1B:
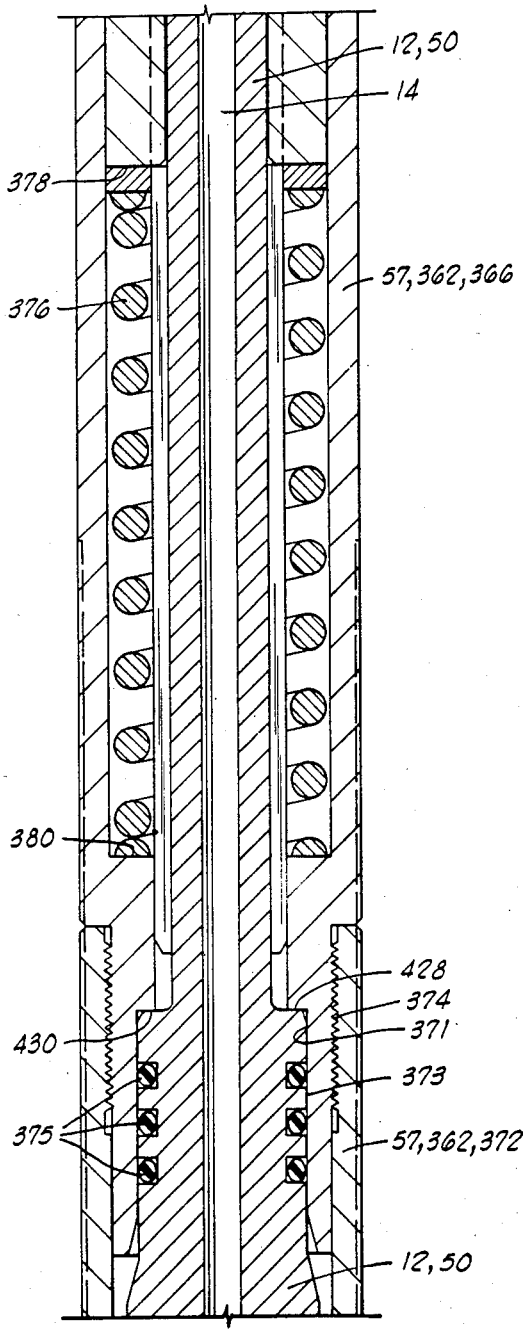
Figure 1C:
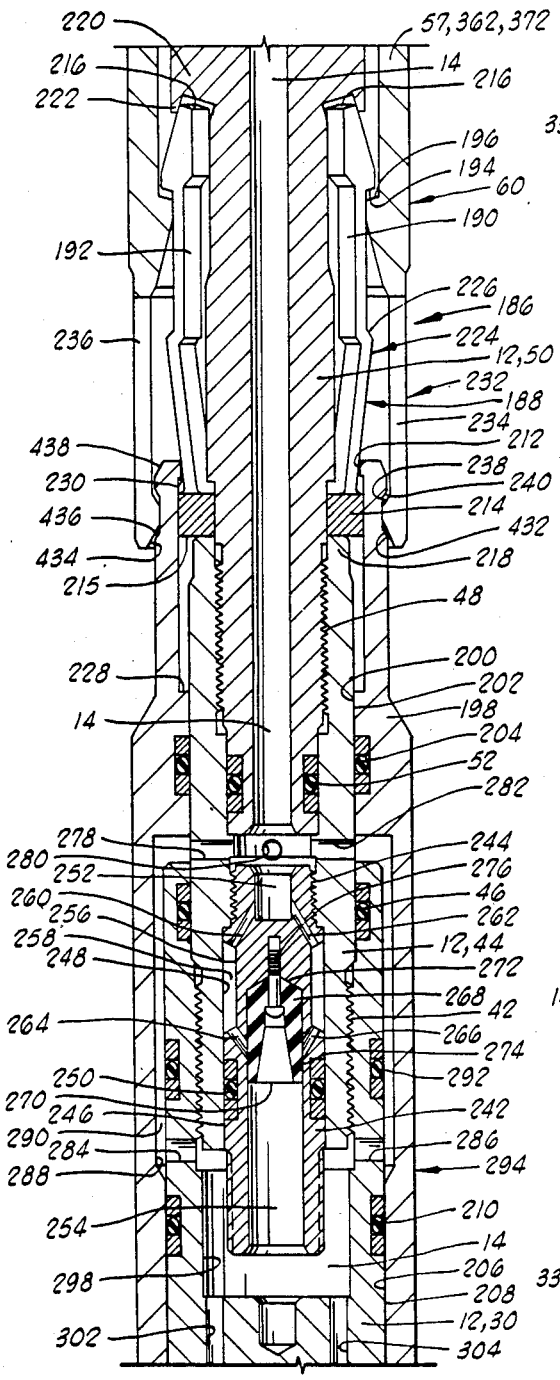
Figure 1D:
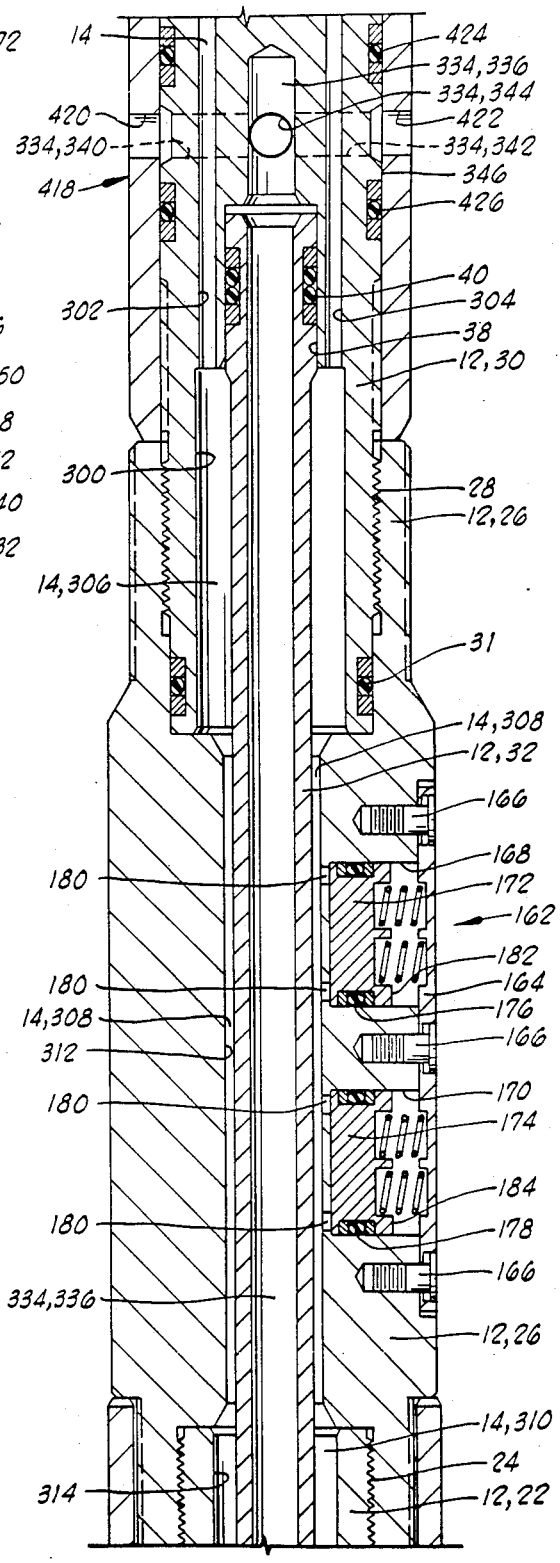
Figure 1E:
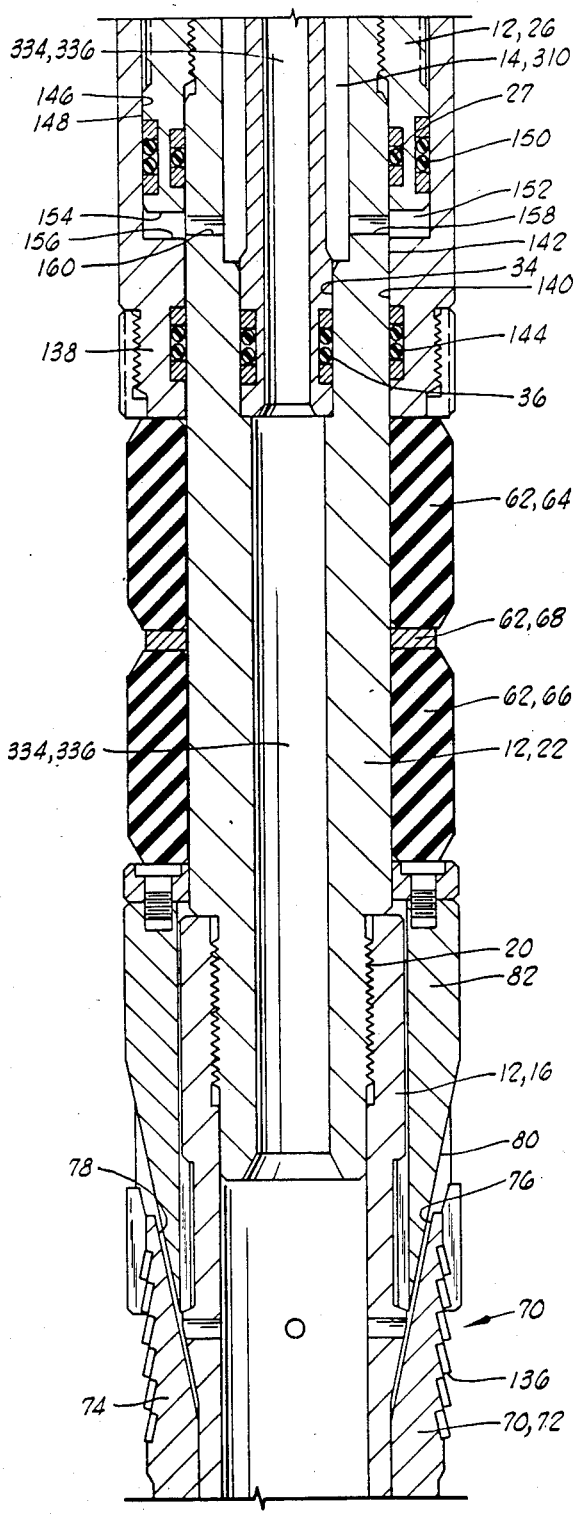
Figure 1F:
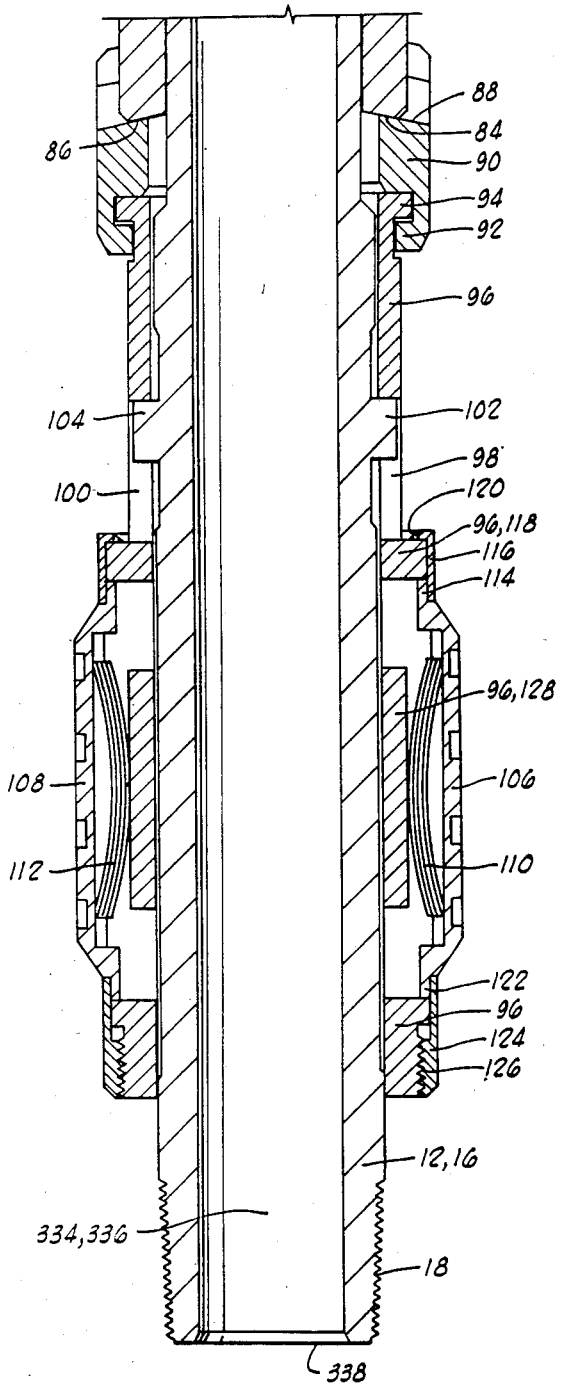

When the fluid pressure is increased within operating fluid passage 14 of mandrel means 12 to operate the power piston means 138 to seal the packer means 62 against the well bore, the radial pistons 172 and 174 are forced radially outward from the position illustrated in FIG. 1D until the radially outer ends 182 and 184 engage the upper slip segment 164 to force it radially outward against the well bore and to thereby anchor the mandrel means 12 within the well bore against any upward directed motion of mandrel means 12 relative to the well bore.

The Release Means And The Power Sleeve

The bridge plug apparatus 10 includes a hydraulically actuatable release means generally designated by the numeral 186, operably associated with the mandrel means 12 and the coupling means 57 for releasing the coupling means 57 from latched connection to the mandrel means 12 in response to a further increase in fluid pressure within the operating fluid passageway 14 after the packer means 62 is expanded by the power piston means 138.

The hydraulically actuatable release means 186 includes a spring collet 188 concentrically received about release mandrel 50 of mandrel means 12 and having a plurality of longitudinally upward extending spring fingers such as 190 and 192.

In connection with the various components of spring collet 188 and related structure, the geometry of those various components will generally be described in this disclosure as extending or facing in an upward direction or in a downward direction. It will be understood, however, that in generally describing the relative orientation of these various components relative to each other, the terms first longitudinal direction and second longitudinal direction can be used in place of upwardly and downwardly, respectively.

Each of the spring fingers such as spring finger 190 of spring collet 188 includes a radially outward extending downward facing shoulder means 194. The downward facing shoulders 194 are arranged to engage an annular radially inward extending upward facing shoulder 196 of coupling means 57 for thereby providing a latched connection between the coupling means 57 and mandrel means 12. That is, so long as the downward facing shoulders 194 of the spring fingers such as 190 of spring collet 188 are located above the upward facing shoulder 196 of coupling means 57, the coupling means 57 cannot be disconnected from the mandrel means 12.

Bridge plug apparatus 10 further includes a power sleeve 198 which is concentrically and slidably received about mandrel means 12. Power sleeve 198 includes a central bore 200 which closely receives an external surface 202 of check valve mandrel 44 with a sliding seal being provided therebetween by resilient O-ring seal means 204.

Power sleeve 198 further includes a downwardly open counterbore 206 which is closely received about an external cylindrical surface 208 of bypass mandrel 30 with a sliding seal being provided therebetween by resilient O-ring seal means 210.

A differential area piston is defined on power sleeve 198 between seals 204 and 210. This differential area piston is in fluid communication with operating fluid passageway 14 of mandrel means 12, and the power sleeve 198 is longitudinally movable relative to mandrel means 12 between a first relative position illustrated in FIGS. 1C–1D and a second upwardly shifted position which is further described below.

Power sleeve 198 can in part be considered to be a portion of the hydraulically actuatable release means 186, and power sleeve 198 has an annular cam surface means 212 defined thereon which engages the spring fingers such as 190 and 192 of spring collet 188. As the power sleeve 198 moves upward from its first position illustrated in FIGS. 1C–1D relative to mandrel means 12, the cam surface 212 which engages spring fingers 190 and 192 biases the spring fingers 190 and 192 radially inward so as to move the shoulders thereof such as 194 radially inward and out of possible engagement with the upward facing annular shoulder 196 of coupling means 57 so as to release the latched connection between the coupling means 57 and the mandrel means 12.

The spring collet 188 has an annular base 214 at a lower first end 215 thereof. The spring fingers such as 190 and 192 have lower first ends attached to the base 214 and have upper free second ends located away from the base 214 and collectively defining an upper second end 216 of spring collet 188.

The spring collet 188 is held in place longitudinally relative to the mandrel means 12 between first and second enlarged diameter portions 218 and 220 of mandrel means 12 which engage the first and second ends 215 and 216, respectively, of spring collet 188.

The first enlarged diameter portion 218 is merely the upper end of check valve mandrel 44. The second enlarged diameter portion 220 is an enlarged diameter portion of release mandrel 50 of mandrel means 12.

Extending downwardly from enlarged diameter portion 220 of release mandrel 50 is a skirt 222, and the second ends 216 of collet spring fingers 190 and 192 are located radially inward of and engage the annular skirt 222.

Each of the spring fingers such as 190 and 192 includes a radially outwardly arched intermediate portion 224 located between the first and second ends thereof.

Each of the arched intermediate portions 224 is arranged to be engaged by the cam surface means 212 of power sleeve 198 and to be moved radially inward thereby as the power sleeve 198 moves upward relative to mandrel means 12.

The radially outward extending shoulders 194 of each of the collet spring fingers 190 and 192 are located nearer to the second end 216 of the spring finger than to the first end thereof, so that the radially outward extending shoulders 194 are moved radially inward as the arched intermediate portions 224 of the collet spring fingers are moved radially inward by the action of power sleeve 198.

The base 214 of spring collet 188 is concentrically located between power mandrel 50 of mandrel means 12 and the power sleeve 198.

Each of the arched intermediate portions 224 of the collet spring fingers such as 190 and 192 includes an upwardly facing tapered shoulder 226.

The second position of power sleeve 198 relative to mandrel means 12 is defined by abutment of a radially inward extending upward facing shoulder 228 of power sleeve 198 with the lower end 215 of base 214 of spring collet 188.

When power sleeve 198 is in this second position with shoulder 228 abutting lower end 215 of spring collet 188, a radially inward extending downward facing shoulder 230 near the upper end of power sleeve 198 is located above the tapered upward facing shoulders 226 of spring collet fingers 190 and 192 thus releasably latching the power sleeve 198 in its said second position relative to the mandrel means 12.

The coupling means 57 includes a coupling collet 232 extending downwardly from a lower end thereof. The coupling collet 232 includes a plurality of downwardly extending coupling spring fingers such as 234 and 236. Each of the coupling spring fingers 234 and 236 includes a radially inward extending upward facing tapered shoulder such as 238.

The power sleeve 198 includes an annular radially outward extending downwardly facing tapered shoulder 240 thereon which is located above the shoulders 238 of coupling collet fingers 234 and 236, so that even after the power sleeve 198 is moved to its said second position relative to mandrel means 12 to release the latched connection between coupling means 57 and mandrel means 12, the coupling means 57 must still be pulled upwardly with sufficient force to bias the coupling spring fingers 234 and 236 radially outward to allow the tapered shoulders 238 thereof to move past the annular tapered shoulder 240 of power sleeve 198.

A check valve housing 242 has an upper end threadedly connected at 244 to an internal threaded bore of check valve mandrel 44. Check valve housing 242 has a cylindrical external surface 246 which is closely received within a counterbore 248 of check valve mandrel 44 with a seal being provided therebetween by resilient O-ring seal means 250.

Check valve housing 242 has disposed therein an upper axial blind bore 252 and a lower axial blind bore 254. Check valve housing 242 also includes a reduced diameter external surface 256 which is spaced radially inward from counterbore 248 of check valve mandrel 44 to define an annular cavity 258.

Upper blind bore 252 is communicated with annular cavity 258 by a plurality of slanted lateral ports such as 260 and 262. Lower blind bore 254 is communicated with annular cavity 258 by a plurality of slanted lateral ports such as 264 and 266.

A cylindrical pliable flapper valve element 268, which is preferably formed from an elastomeric material, has an open lower end 270 and a closed upper end 272. Flapper valve element 268 has a cylindrical external surface 274 which is closely received within lower blind bore 254, and the flapper valve element 268 is held in place relative to check valve housing 242 by a threaded bolt 276.

The cylindrical outer surface 274 of flapper valve element 268 covers the lower ends of the ports such as 264 and 266 where they join with lower blind bore 254.

Flapper valve element 268 in combination with check valve housing 242 and particularly the ports 264 and 266 thereof provides a one-way check valve means disposed in the operating fluid passageway 14 of mandrel means 12. As is apparent in FIG. 1C, the flapper valve element 268 will permit downward flow through upper blind bore 252, ports 260 and 262, annular cavity 258, ports 264 and 266, and lower blind bore 254, but will not permit upward flow therethrough.

The one-way check valve means provided by flapper valve element 268 provides an important function after the bridge plug apparatus 10 is set in place within a well bore and after fluid pressure has been trapped behind the power piston means 138 and the hydraulic second slip means 162 as is further described below. When the bridge plug apparatus has been left in the well bore in the manner just described, it is important that provision be made for balancing any increase in pressure within the well bore above the packer means 62 of bridge plug apparatus 10 across the hydraulic upper slips 162 to prevent the hydraulic upper slips 162 from being pumped inward which would cause them to release their grip on the well bore.

Thus, the flapper valve element 268 will allow increases in fluid pressure in the well bore above the packer means 62 to be transmitted to that portion of the operating fluid passageway 14 which is communicated with the hydraulic second slip means 162 and the power piston means 138 to prevent the hydraulic second slip means 162 from releasing its anchored engagement with the well bore due to such increases in fluid pressure within the well bore.

When the bridge plug apparatus 10 is in its initial position as illustrated in FIGS. 1C–1D, the flapper valve element 268 is basically non-functional, since the operating fluid passageway 14 circumvents the flow passages just described through the check valve housing 242.

As seen in FIG. 1C, check valve mandrel 44 of mandrel means 12 includes a plurality of lateral ports such as 278, 280 and 282 disposed therethrough which communicate the operating fluid passageway 44 above the flapper valve element 268 with an exterior surface of check valve housing 44.

Also, bypass mandrel 30 includes a plurality of lateral ports such as 284 and 286 disposed therethrough which communicate the operating fluid passageway 14 below flapper valve element 268 with an exterior of the bypass mandrel 30 of mandrel means 12.

The power sleeve 198 includes an enlarged internal diameter cylindrical surface 288 which defines an annular cavity 290 which communicates the ports 278, 280 and 282 with the ports 284 and 286 when the power sleeve 198 is in its first position relative to mandrel means 12 as illustrated in FIGS. 1C–1D.

The Power Sleeve, The Bypass And The Coupling Means

A resilient O-ring seal means 292 is disposed within an annular cavity in the cylindrical outer surface of bypass mandrel 30 above the ports 284 and 286.

An intermediate portion 294 of power sleeve 198 upon which is defined the counterbore 206 thereof, in conjunction with the ports 284 and 286 and the O-ring seal means 294 provides a hydraulically actuatable valve means, generally referred to by the numeral 294, for trapping fluid under pressure in a portion of operating fluid passageway 14 communicated with the hydraulic second slip means 162 and the power piston means 138 as the power sleeve 198 moves from its said first position to its previously described second position relative to mandrel means 12. As power sleeve 198 moves upward, its counterbore 206 closes ports 284 and 286 and then seals against resilient O-ring seal 292 to trap fluid in the operating fluid passageway 14 below the flapper valve element 268.

When the ports 284 and 286 are closed off in this manner, fluid flow through the operating fluid passageway 14 can only flow in a downward direction as previously described through the various passages of check valve housing 242, and upward flow therethrough is prevented by the action of flapper valve element 268.

This traps the increased fluid pressure in that portion of operating fluid passageway 14 communicated with the hydraulic second slip means 162 and the power piston 138 and thus holds the power piston 138 and the hydraulic second slip means 162 in their expanded positions so that hydraulic slip means 162 grips the well bore and so that packer means 62 is sealed against the well bore.

This portion of the operating fluid passageway 14 communicated with hydraulic slip means 162 and power piston 138 includes an upper blind bore 298 of bypass mandrel 30, a lower blind bore 300 of bypass mandrel 30 and a plurality of longitudinal offset passageways such as 302 and 304 of bypass mandrel 30 which communicate its upper and lower blind bores 298 and 300. This portion of operating fluid passageway 14 communicated with the hydraulic upper slips 162 and power piston means 138 further includes annular cavities 306, 308 and 310 defined between bypass tube 32 and blind bore 300 of bypass mandrel 30, bore 312 of hydraulic slip body 26, and upper counterbore 314 of packer mandrel 22, respectively.

As previously described, if there are increases in fluid pressure within the well bore itself above the packer means 62, which increases are greater than the fluid pressure contained in operating fluid passageway 14 below the flapper valve element 268, flapper valve element 268 will open the ports 264 and 266 to permit that increased fluid pressure to be balanced across the hydraulic upper slips 162 to prevent them from being pumped inward and thereby releasing their grip on the well bore.

The coupling means 57 seen in FIGS. 1A–1C has a central flow passage means 296 disposed therethrough for communicating an interior of the tubing string which is connected to threaded connection 58 of coupling means 57 with the operating fluid passageway 14 of the mandrel means 12.

The bridge plug apparatus 10 further includes a bypass means 334, comprised of a number of interconnected passageways, for allowing well fluid from below the packer means 62 to flow upward through the bridge plug apparatus 10 and into the tubing string connected to the threaded connection 58 of coupling means 57 as the bridge plug apparatus 10 is lowered on such a tubing string into the well bore.

The bypass means 334 includes a lower bypass passage 336 which extends upward from a lower end 338 of drag block mandrel 16 through the drag block mandrel 16, then through the packer mandrel 22, then through the bypass tube 32, then partially through the bypass mandrel 30.

Bypass means 334 further includes a plurality of lower bypass ports such as 340, 342 and 344 disposed through the bypass mandrel 30 of mandrel means 12 above the packer means 62 and communicating the lower bypass passage 336 with an exterior surface 346 of bypass mandrel 30.

Bypass means 334 further includes a plurality of upper bypass ports such as 348, 350 and 352 disposed through the coupling means 57 and connecting an exterior surface 354 of coupling means 57 with the flow passage means 296 of coupling means 57.

As seen in FIGS. 1A–1E, coupling means 57 includes an upper tubular portion 356 comprised of an upper adapter 358 and an upper bypass sleeve 360, which are threadedly connected at 359 with a seal being provided therebetween by resilient O-ring seal means 361.

The coupling means 57 further includes a lower tubular portion 362 which is comprised of an outer tubular collar 364, a spring housing 366 threadedly connected to collar 362 at 368 with a seal being provided therebetween by resilient O-ring seal means 370, and a lower latching sleeve 372 threadedly connected to a lower end of spring housing 366 at 374.

Spring housing 366 has a cylindrical inner bore 371 within which is closely received a cylindrical outer surface 373 of release mandrel 50 with a plurality of resilient O-ring seals such as 375 being provided therebetween.

The upper and lower tubular portions 356 and 362 of coupling means 57 are telescoping tubular portions, with the upper tubular portion 356 being telescopingly received within the lower tubular portion 362. These upper and lower tubular portions 356 and 362 are telescopingly movable relative to each other between a first position as illustrated in FIG. 1A wherein the upper bypass ports 348, 350 and 352 are open, and a second position wherein the upper bypass ports 348, 350 and 352 are closed.

As seen in FIGS. 1A–1C, the first relative position of the upper and lower tubular portions 356 and 362 is a telescopingly extended position. A resilient coil biasing spring 376 is received between a lower end 378 of upper bypass sleeve 360 and an upward facing annular shoulder 380 of spring housing 366 for urging the first and second tubular portions 356 and 362 of coupling means 57 towards their telescopingly extended first relative position which is defined by abutment of a lower end 377 of collar 364 with an upward facing annular shoulder 379 of upper bypass sleeve 360. Spring 376 also is strong enough to hold the upper bypass ports 348, 350 and 352 open against the drag of drag blocks 106 and 108 as the bridge plug apparatus 10 is lowered into the well bore.

In this first relative position, it is seen that each of the upper bypass ports such as 348 includes an inner portion such as 382 disposed through upper bypass sleeve 360 and a radially outer portion such as 384 disposed through collar 364, which inner and outer portions 382 and 384 are in registry with each other.

A seal is provided between upper bypass sleeve 360 and collar 362 by resilient O-ring seal means 386.

When weight is set down on the tubing string connected to coupling means 57, to operate the lugs 102 and 104 of mandrel means 12 within the J-slots 98 and 100 of drag block sleeve 96 as previously described, the downward movement causes the upper tubular portion 356 of coupling means 57 to telescope downwardly relative to the lower tubular portion 362 of coupling means 57, thus compressing coil spring 376 until a lower end 388 of upper adapter 358 abuts an upper end 390 of collar 364.

The upper bypass sleeve 360 of coupling means 57 includes a plurality of radially inward extending splines such as 392 and 394 which mesh with a plurality of radially outward extending splines such as 396 and 398 of release mandrel 50 for transfer of rotational motion therebetween. That is, the coupling means 57 cannot rotate relative to the mandrel means 12 although relative longitudinal sliding movement therebetween is provided.

The upper ends of each of the splines 396 and 398 of release mandrel 50 are tapered as at 400 and 402 to an upper point.

As seen in FIG. 1A, the mandrel nose 54 includes a plurality of lateral ports such as 404 and 406 disposed therethrough which communicate a blind bore 408 thereof with the longitudinal passageway 296 of coupling means 57.

An annular resilient spring ring 410 is received about a reduced diameter portion of mandrel nose 54 and held longitudinally in place between a downward extending shoulder 412 of mandrel nose 54 and an upper end 414 of release mandrel 50.

The spring ring 410 is constructed such that in its relaxed position as shown in FIG. 1A, it has an outside diameter greater than an internal diameter of upper intermediate tubular portion 356 at the radially inner ends such as 416 of the splines such as 392.

Thus, when the coupling means 57 is pulled upward out of engagement with the mandrel means 12 after the bridge plug apparatus 10 has been set within a well bore, the spring ring 410 is cammed radially inward so that the upper bypass sleeve 360 of coupling means 57 may move upward past spring ring 410.

Spring ring 410 is constructed so as to require approximately a 1000-pound force in tension on the coupling means 57 to cause the spring ring 410 to be cammed inward and to subsequently pull the coupling means 57 upward past the spring ring 410. Once the lower end 378 of upper bypass sleeve 360 passes to a point above the spring ring 410, this 1000-pound force is released which provides an observable indication to the well operator at the surface.

Similarly, when the coupling means 57 is lowered back into the well bore to reconnect to the mandrel means 12 for retrieval of the bridge plug apparatus 10, a similar 1000-pound downward force is required to push the coupling means 57 into place over the snap ring 410, again providing an observable indication to the well operator at the surface.

Referring now to FIG. 1D, the power sleeve 198 includes a portion thereof generally indicated by the numeral 418 which may be described as a valve portion defined on the power sleeve 198 for closing the lower bypass ports such as 340, 342 and 344 of bypass means 334 as the power sleeve 198 moves from its first position illustrated in FIGS. 1C–1D to its second position relative to mandrel means 12 as previously described.

This valve portion 418 of power sleeve 198 includes a plurality of lateral ports such as 420 and 422 disposed therethrough which are in registry with the lower bypass ports such as 340 and 342 when the power sleeve 198 is in its first position so as to communicate those lower bypass ports such as 340 and 342 with the well bore exterior of power sleeve 198.

When the power sleeve 198 moves upward from its first position illustrated in FIGS. 1C–1D to its previously described second position, the ports such as 420 and 422 thereof move upward past a resilient O-ring seal 424 which in combination with a lower resilient O-ring seal 426 effectively closes the lower bypass ports such as 340 and 342.

Summary Of The Operation

The bridge plug apparatus 10 is first made up in a tool string. The upper adapter 358 has its upper internal threads 58 connected either to a tubing string or to another tool such as perhaps a packer which may be located in the tubing string above the bridge plug apparatus 10.

Then the tubing string with the attached bridge plug apparatus 10 is lowered into a well bore to the position where it is desired to set the bridge plug 10 to seal the well bore.

As the bridge plug apparatus 10 is lowered on the tubing string into the well bore, well fluids located below the packer means 62 of bridge plug apparatus 10 may flow upward through the lower bypass passage 336, lower bypass ports 340, 342 and 344, the upper bypass ports 348, 350 and 352, and through the flow passage 296 into the interior of tubing string to which the bridge plug apparatus 10 is attached.

Once the bridge plug apparatus 10 is located on its desired final location within the well bore, the well operator picks up weight from the tubing string and simultaneously torques the tubing string counterclockwise as viewed from above. This motion moves each of the lugs, such as lug 102, from its initial position in the lower end of the short leg 130 of J-slot 198 to the position designated by 102C in FIG. 2 at the upper end of the long leg portion 132 of the J-slot 98.

These lifting or tension forces are transmitted through the bridge plug apparatus 10 in the following manner. The lifting force is transmitted from the upper adapter 358 and upper bypass sleeve 360 to the collar 364 by the abutment of shoulder 379 of upper bypass sleeve 360 with the shoulder 377 of collar 364. The tension load is then transmitted from collar 364 through spring housing 366 and latching sleeve 372 to the mandrel means 12 by the engagement of upward facing annular shoulder 196 of latching sleeve 372 with the downward facing shoulders such as 194 on each of the spring fingers such as 190 and 192 of spring collet 188. These upward forces exerted on the shoulders 194 of the collet spring fingers of spring collet 188 are compressionally transferred to the upper end 216 of spring collet 188 which engages the enlarged diameter portion 220 of release mandrel 50 thus transferring these tension loads to the release mandrel 50 of mandrel means 12.

Then, the well operator slacks off weight on the tubing string. As weight is slacked off on the tubing string, i.e., as weight is set down on the bridge plug apparatus 10 itself, the upper and lower tubular portions 356 and 362 of coupling means 57 telescope together so as to close the upper bypass ports 348, 350 and 352. Also, as weight is set down on the bridge plug apparatus 10, the mandrel means 12 is moved downwardly relative to the drag block sleeve 96 to move the lugs such as 102 downward within the long leg portion 132 of J-slot 98 so as to cause the mechanical lower slips 70 to be moved radially outward and set against the well bore to anchor the mandrel means 12 against downward movement relative to the well bore.

This downward force also puts a light initial squeeze on the packer means 62 which provides a slight expansion thereof to begin sealing the packer means 62 against the well bore.

This downward transfer of weight and compression through the bridge plug apparatus 10 is carried by the bridge plug apparatus 10 as follows. The downward loads on upper adapter 358 are transferred to collar 364 by engagement of the shoulders 388 and 390. These loads are transferred from collar 364 through spring housing 366 to an upward facing shoulder 428 of release mandrel 50 of mandrel means 12 by engagement thereof with a downward facing shoulder 430 of spring housing 366.

With the mechanical lower slips 70 anchored against the well bore, and with the upper bypass ports 348, 350 and 352 closed, the bridge plug apparatus 10 is now in position for the actuation of the packer means 62 and the hydraulic upper slips 162 by the application of fluid pressure within the interior of the tubing string which is then communicated to the operating fluid passageway 14 of the mandrel means 12 of bridge plug apparatus 10.

As the pressure within operating fluid passageway 14 is increased, the power piston means 138 moves downward to expand packer means 62 to seal packer means 62 against the well bore, and the radial pistons 172 and 174 move outward to set the hydraulic upper slips 162 against the well bore.

Initially as the pressure is increased within the operating fluid passageway 14, upward movement of power mandrel 198 relative to mandrel means 12 is prevented due to engagement of downward facing annular tapered shoulders such as 432 and 434 on the lower ends of coupling spring fingers such as 234 and 236 of coupling collet 232 of latching sleeve 372 with an upward facing annular shoulder 436 defined on the outer surface of power sleeve 198.

The coupling spring fingers such as 234 and 236 of coupling collet 232 are constructed so that they will hold the power sleeve 198 in its first position illustrated in FIGS. 1C–1D against the pressures required in operating fluid passageway 14 to actuate the power piston means 138 and the hydraulic upper slips 162.

After the power piston 138 and the hydraulic upper slips 162 are actuated, further increases in the fluid pressure within operating fluid passageway 14 cause the lower ends of coupling spring fingers 234 and 236 to be cammed radially outward so that power sleeve 198 may then move upward from its first position illustrated in FIGS. 1C–1D to a second position relative to mandrel means 12 wherein shoulder 230 of power sleeve 198 is latched over the upward facing shoulders 226 of the arched intermediate portions 224 of the collet spring fingers such as 190.

As the power sleeve 198 moves upward from its first position to its second position relative to mandrel means 12, the valve portion 418 thereof moves past the lower bypass ports 340, 342 and 344 to close the bypass means 334. Also, the portion 294 thereof moves upward to close the ports 284 and 286 of bypass mandrel 30 thus trapping fluid under pressure within that portion of the operating fluid passageway 14 below the one-way check valve means 268. Finally, the cam surface 212 at the upper end of power sleeve 198 compresses the collet spring fingers such as 190 and 192 radially inward so as to move the shoulders such as 194 thereof radially inward out of engagement with the upward facing annular shoulder 196 of latching sleeve 372 thus releasing the latched connection between coupling means 57 and mandrel means 12.

Then, the well operator pulls upward on the tubing string with a sufficient force to cam the coupling spring fingers 234 and 236 of coupling collet 232 radially outward past the downward facing shoulder 240 of power sleeve 198, and also the upward pull must be with sufficient force to cause the spring ring 410 to be cammed radially inward so that the upper bypass sleeve 360 of coupling means 57 may pass upward past the spring ring 410.

At that point, the bridge plug apparatus 10 is in place within the well bore and flow through the well bore is prevented since the operating fluid passageway 14 is closed. Any increases in fluid pressure within the well bore above the packer means 62 may be transmitted to that portion of operating fluid passageway 14 below the one-way check valve means 268 through the operation of the one-way check valve means 268 as previously described.

Later, when it is desired to retrieve the bridge plug apparatus 10, the coupling means 57 is again lowered on the tubing string into engagement with the mandrel means 12.

As will be understood by those skilled in the art, quite often a considerable amount of debris, often including sand, is piled up on top of the packer means 62 within the well bore. Often this may cover the mandrel nose 54 of mandrel means 12.

As the coupling means 57 is lowered into the well to reconnect with the mandrel means 12, fluid is normally pumped down through the interior of the pipe string and thus through the flow passage 296 of coupling means 57 to wash away this debris.

Due to the provision of the coupling collet 232 on the lower end of coupling means 57, this downward flowing fluid may flow radially outward between the coupling spring fingers such as 234 and 236 to aid in providing this washing action to remove the debris from around mandrel means 12 as the coupling means 57 is lowered slowly into place over the mandrel means 12.

During this lowering operation, downward facing tapered surfaces such as 432 and 434 of coupling spring fingers 234 and 236 of coupling collet 232 will abut an upward facing tapered surface 438 of power sleeve 198 and push the power sleeve 198 downward past the shoulders such as 226 of coupling spring finger 190 back to the original position of power sleeve 198 relative to mandrel means 112. This is permitted by the taper of shoulders 226 which causes arched portions 224 of collet spring fingers 190 and 192 to be cammed radially inward.

When the power sleeve 198 has been re-cocked to its position relative to mandrel means 12 as shown in FIGS. 1C–1D, the coupling spring fingers such as 234 and 236 will then be cammed outwardly past annular shoulder 438 of power sleeve 198 and will snap into the groove defined in power sleeve 198 between the shoulders 240 and 436 thereof.

As the power sleeve 198 is moved back downward to its initial position, the fluid pressure against the power piston means 138 and the hydraulic upper slips 162 is relieved, and also the lower bypass ports 340, 342 and 344 are reopened.

Then, the bridge plug apparatus 10 may be retrieved merely by pulling upward on the tubing string. The mechanical lower slips 70 will release and the bridge plug apparatus 10 may then be freely pulled upward through the well bore.

Thus, it is seen that the apparatus of the present invention readily achieves the ends and advantages mentioned as well as those inherent therein. While certain preferred embodiments of the invention have been illustrated for the purposes of the present disclosure, numerous changes in the arrangement and construction of parts may be made by those skilled in the art, which changes are encompassed by the scope and spirit of the present invention as defined by the appended claims.

What is claimed is:

1. A bridge plug apparatus, comprising:

a mandrel means having an operating fluid passageway disposed therein;

a releasable coupling means, having an upper end adapted to engage a tubing string and having a lower portion adapted to be releasably connected to said mandrel means;

an annular packer means disposed about said mandrel means;

mechanical first slip means, connected to said mandrel means, for anchoring said mandrel means within a well bore upon manipulation of said tubing string;

hydraulic second slip means, connected to said mandrel means on a side of said packer means opposite said first slip means, for anchoring said mandrel means within said well bore in response to an increase in fluid pressure within said operating fluid passageway;

power piston means for longitudinally compressing and radially expanding said packer means to seal said packer means against said well bore in response to an increase in fluid pressure in said operating fluid passageway; and hydraulically actuatable release means, operably associated with said mandrel means and said coupling means, for releasing said coupling means from latched connection to said mandrel means in response to a further increase in fluid pressure within said operating fluid passageway after said packer means is expanded by said power piston means.

2. The apparatus of claim 1, wherein:

said mechanical first slip means is located below said packer means for anchoring said mandrel means against downward movement within said well bore; and said hydraulic second slip means is located above said packer means for anchoring said mandrel means against upward movement within said well bore.

3. The apparatus of claim 1, further comprising:

hydraulically actuatable valve means for trapping fluid under pressure in a portion of said operating fluid passageway communicated with said hydraulic second slip means and said power piston means and for thereby maintaining said hydraulic second slip means anchored in said well bore and said packer means sealed against said well bore;

wherein said hydraulically actuatable release means and said hydraulically actuatable valve means are both defined upon a power sleeve which is slidably disposed about said mandrel means; and wherein said power sleeve has a differential area piston defined thereon which is in fluid communication with said operating fluid passageway of said mandrel means.

4. The apparatus of claim 1, further comprising:

hydraulically actuatable valve means for trapping fluid under pressure in a portion of said operating fluid passageway communicated with said hydraulic second slip means and said power piston means and for thereby maintaining said hydraulic second slip means anchored in said well bore and said packer means sealed against said well bore.

5. The apparatus of claim 1, further comprising:

one-way check valve means, disposed in said operating fluid passageway of said mandrel means, for allowing increases in fluid pressure in said well bore above said packer means to be transmitted to a portion of said operating fluid passageway communicated with said hydraulic second slip means and said power piston means, and for thereby preventing said hydraulic second slip means from releasing its anchored engagement with said well bore due to said increases in fluid pressure in said well bore above said packer means, said check valve means including a pliable flapper valve element.

6. The apparatus of claim 1, wherein:

said coupling means has a flow passage means disposed therethrough for communicating an interior of said tubing string with said operating fluid passageway of said mandrel means; and said apparatus further includes a bypass means for allowing well fluid from below said packer means to flow upward through said apparatus and into said tubing string as said apparatus is lowered on said tubing string into said well bore, said bypass means including:

a lower bypass passage disposed longitudinally through a portion of said mandrel means extending from below said packer means to above said packer means;

a lower bypass port disposed through said mandrel means above said packer means and communicating said lower bypass passage with an exterior surface of said mandrel means; and an upper bypass port disposed through said coupling means and connecting an exterior surface of said coupling means with said flow passage means of said coupling means.

7. The apparatus of claim 6, wherein:

said coupling means includes upper and lower telescoping tubular portions, said upper bypass port being partially disposed through each of said upper and lower portions, said upper and lower portions being telescopingly movable relative to each other between a first position wherein said upper bypass port is open and a second position wherein said upper bypass port is closed.

8. The apparatus of claim 7, wherein:

said first relative position of said first and second portions of said coupling means is a telescopingly extended position; and said coupling means further includes resilient biasing means for urging said first and second portions of said coupling means toward said telescopingly extended first relative position.

9. The apparatus of claim 6, further comprising:

a power sleeve slidably disposed about said mandrel means and having a differential area piston defined thereon which is in fluid communication with said operating fluid passageway of said mandrel means, said power sleeve being longitudinally movable relative to said mandrel means between a first position wherein said lower bypass port is open and a second position wherein said lower bypass port is closed in response to a change in fluid pressure within said operating fluid passageway.

10. The apparatus of claim 9, further comprising:

hydraulically actuatable release means, operably associated with said mandrel means and said coupling means, for releasing said coupling means from latched connection to said mandrel means in response to a further increase in fluid pressure within said operating fluid passageway after said packer means is expanded by said power piston means;

hydraulically actuatable valve means for trapping fluid under pressure in a portion of said operating fluid passageway communicated with said hydraulic second slip means and said power piston means and for thereby maintaining said hydraulic second slip means anchored in said well bore and said packer means sealed against said well bore; and wherein said hydraulically actuatable release means and said hydraulically actuatable valve means are both defined on said power sleeve.

11. A well tool apparatus, comprising:

a mandrel means having an operating fluid passageway disposed therein;

a releasable coupling means adapted to be releasably connected to said mandrel means, said coupling means having a radially inward extending shoulder defined thereon which faces in a first longitudinal direction; and hydraulically actuatable release means, including:

a spring collet concentrically received about said mandrel means and having a plurality of longitudinally extending spring fingers, each of said spring fingers including a radially outward extending shoulder means facing in a second longitudinal direction opposite said first longitudinal direction for engaging said radially inward extending shoulder of said coupling means and for thereby providing a latched connection between said coupling means and said mandrel means, said spring collet having an annular base at a first end thereof, with said spring fingers having first ends attached to said base and having second ends located away from said base and collectively defining a second end of said spring collet, said spring collet being held in place longitudinally relative to said mandrel means between first and second enlarged diameter portions of said mandrel means engaging said first and second ends, respectively, of said spring collet;

a power sleeve concentrically and slidably received about said mandrel means and having a differential area piston defined thereon which is in fluid communication with said operating fluid passageway of said mandrel means, said power sleeve being longitudinally movable between first and second positions relative to said mandrel means in response to a change in fluid pressure within said operating fluid passageway; and said power sleeve having a cam surface means defined thereon for engaging said spring fingers of said spring collet and for biasing said spring fingers radially inward to release said latched connection between said coupling means and said mandrel means as said power sleeve moves from its said first position to its said second position.

12. The apparatus of claim 11, wherein:

said second ends of said spring fingers are located radially inward of and engage an annular skirt of said second enlarged diameter portion of said mandrel means.

13. The apparatus of claim 11, wherein:

each of said spring fingers includes a radially outwardly arched intermediate portion located between said first and second ends thereof, said arched intermediate portion being arranged to be engaged by said cam surface means of said power sleeve and to be moved radially inward thereby; and said radially outward extending shoulder of each of said spring fingers is located nearer to said second end of said spring finger than to said first end of said spring finger, so that said radially outward extending shoulder is moved radially inward as said intermediate portion of said spring finger is moved radially inward.

14. The apparatus of claim 11, wherein:

said annular base of said spring collet is concentrically located between said mandrel means and said power sleeve.

15. The apparatus of claim 11, wherein:

said coupling means includes a coupling collet extending in said second longitudinal direction from an end thereof, said coupling collet including a plurality of coupling spring fingers extending in said second longitudinal direction therefrom, each of said coupling spring fingers including a radially inward extending tapered shoulder thereon facing in said first longitudinal direction; and said power sleeve includes an annular radially outward extending tapered shoulder thereon facing in said second longitudinal direction, said shoulder of said power sleeve being located in said first direction from and facing said tapered shoulders of said coupling spring fingers, so that even after said power sleeve is moved to its second position to release said latched connection between said coupling means and said mandrel means, said coupling means must still be pulled in said first longitudinal direction with sufficient force to bias said coupling spring fingers radially outward to allow said tapered shoulders thereof to move past said annular tapered shoulder of said mandrel means.

16. The apparatus of claim 11, wherein:

said spring collet further includes means for releasably latching said power sleeve in its said second position relative to said mandrel means.

17. A bridge plug apparatus, comprising:

a mandrel means having an operating fluid passageway disposed therein, and having a bypass passage disposed therethrough;

an annular packer means disposed about said mandrel means;

power piston means, operatively associated with said mandrel means and said packer means, for longitudinally compressing and radially expanding said packer means to seal said packer means against a well bore in response to a change in fluid pressure in said operating fluid passageway;

a releasable coupling means, having an upper end adapted to engage a tubing string and having a lower portion adapted to be releasably connected to said mandrel means; and a power sleeve concentrically and slidably received about said mandrel means and having a differential area piston defined thereon which is in fluid communication with said operating fluid passageway of said mandrel means, said power sleeve being longitudinally movable between first and second positions relative to said mandrel means in response to a further change in fluid pressure within said operating fluid passageway after said packer means is expanded by said power piston means, said power sleeve including:

a first valve portion defined thereon for closing said bypass passage of said mandrel means as said power sleeve moves from its said first position to its said second position;

a second valve portion defined thereon for trapping fluid under pressure in a portion of said operating fluid passageway communicated with said power piston means as said power sleeve moves from its said first position to its said second position; and a release means defined thereon for releasing said releasable coupling means from latched connection to said mandrel means as said power sleeve moves from its said first position to its said second position.

18. The apparatus of claim 19, further comprising:

one-way check valve means, disposed in said operating fluid passageway of said mandrel means, for allowing increases in fluid pressure in said well bore above said packer means to be transmitted to said portion of said operating fluid passageway communicated with said power piston means;

wherein said mandrel means includes a first lateral port disposed therethrough communicating said operating fluid passageway above said check valve means with an exterior of said mandrel means, and said mandrel means includes a second lateral port disposed therethrough communicating said operating fluid passageway below said check valve means with said exterior of said mandrel means; and said power sleeve includes an enlarged internal diameter surface defining an annular cavity which communicates said first and second lateral ports of said mandrel means when said power sleeve is in its said first position relative to said mandrel means.

* * * * *